US006505351B2

(12) United States Patent
Yeh

(10) Patent No.: US 6,505,351 B2
(45) Date of Patent: Jan. 14, 2003

(54) HAIR RING OR HAIR STRIP WITH DOLL MASK

(76) Inventor: Chia-Ching Yeh, PO Box 82-144, Taipei (TW)

( * ) Notice: Subject to any disclaimer, the term of this patent is extended or adjusted under 35 U.S.C. 154(b) by 0 days.

(21) Appl. No.: 09/747,989

(22) Filed: Dec. 27, 2000

(65) Prior Publication Data

US 2002/0020002 A1 Feb. 21, 2002

(30) Foreign Application Priority Data

Aug. 11, 2000 (TW) ..... 089213993

(51) Int. Cl.[7] ..... A42B 1/18

(52) U.S. Cl. ..... 2/206; 2/9; 446/27; 472/133

(58) Field of Search ..... 2/206, DIG. 11, 2/202, 9; 446/27; 472/70, 133

(56) References Cited

U.S. PATENT DOCUMENTS 2,262,992 A * 11/1941 Dessart ..... 2/206
3,089,148 A * 5/1963 Grossberg ..... 2/206
4,729,747 A * 3/1988 Yeh ..... 446/27

* cited by examiner

*Primary Examiner*—John J. Calvert
*Assistant Examiner*—Katherine Moran

(57) ABSTRACT

A hair ring or hair strip with a doll mask is formed by a hair ring, a plastic mask, and two plastic ears. After assembling the three components, surface layers are adhered to the inner and outer surfaces of the mask. The nose bridge at the center of the mask and the edge of the ears are installed with a plurality of enhancing trenches, and a plurality of slender metal wires are embedded into the trenches. An edge of the ear is added with a bank of slots, thereby, as the ear is bent, no wrinkle generates to appear a bad appearance. An elastic cord can be further added to the hair ring or forehead of the mask so as to be more stable and prevent from fall down after being worn. The present invention can be worn for a longer time without feeling of pressure.

14 Claims, 8 Drawing Sheets

HAIR RING OR HAIR STRIP WITH DOLL MASK

FIELD OF THE INVENTION

The present invention relates to a hair ring or hair strip with a doll mask serves for replacing the prior art mask The present invention can be worn easily by children without effecting the hair style.

BACKGROUND OF THE INVENTION

The decorating masks worn by children are illustrated in FIG. 1. Two sides of a mask 11 are tied with respective elastic cords 12. The defect of this design is that the elastic cords are too tight to be worn comfortably. Moreover, the mask will make some difficulties to the breathing or viewing of the user. In order to avoid this problem, a decoration with a simple structure, as shown in FIG. 2, a hat 14 with ears or a head cover 16 with ears 15, as shown in FIG. 3; further, a hair ring 18 with horns 17, as shown in FIG. 4, are developed. However, these designs have the defects of lack of interesting and attraction. Therefore, in some festivals, these dolls can not attract the attentions of children. The mask shown in FIG. 1 is not suitable since it can not be used for a longer time period.

SUMMARY OF THE INVENTION

A hair ring or hair strip with a doll mask serves for replacing the prior art mask which is tied by a hair ring with ears, a hat, a head cover, or an elastic cord. The hair ring or hair strip with a doll mask of the present invention is formed by a hair ring, a plastic mask, and two plastic ears. The hair ring, mask, and ears are made individually and then are assembled as an integral body; or the mask and ears are formed integrally and then are assembled with the hair ring; or the hair ring, mask and ears are formed integrally. After those components are assembled, surface layers are adhered to an inner and an outer wall of the mask. The surface layer is a cloth, a terry surface, a plastic film. After assembling the three components, surface layers are adhered to the inner and outer surfaces of the mask. The nose bridge at the center of the mask and the edge of the ears are installed with a plurality of enhancing trenches, and a plurality of slender metal wires are embedded into the trenches. An edge of the ear is added with a banks of slots, thereby, as the ear is bent, no wrinkle generates for appearing a bad appearance. An elastic cord can be further added to the hair ring or forehead of the mask so as to be more stable and prevent from falling down after being worn. The present invention can be worn easily by children without effecting the hair style.

The various objects and advantages of the present invention will be more readily understood from the following detailed description when reading in conjunction with the appended drawing.

DETAILED DESCRIPTION OF THE PREFERRED EMBODIMENTS

The detail of a hair ring or hair strip with a doll mask according to the present invention will be described in the following with appended figures.

Figure 1:
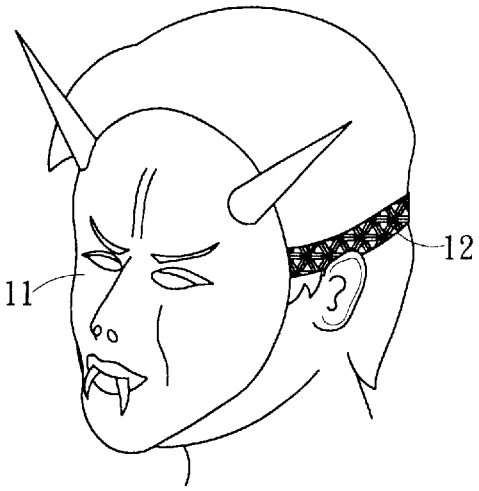
FIG. 1 shows a mask of a prior art elastic cord.
Figure 3:
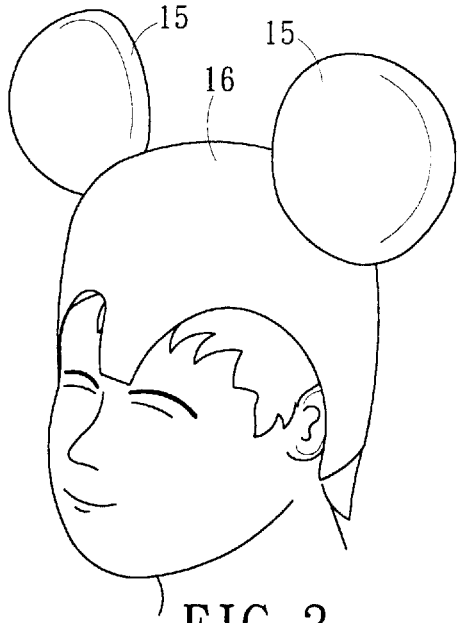
FIG. 3 is a prior art head cover with doll ears.
Figure 2:
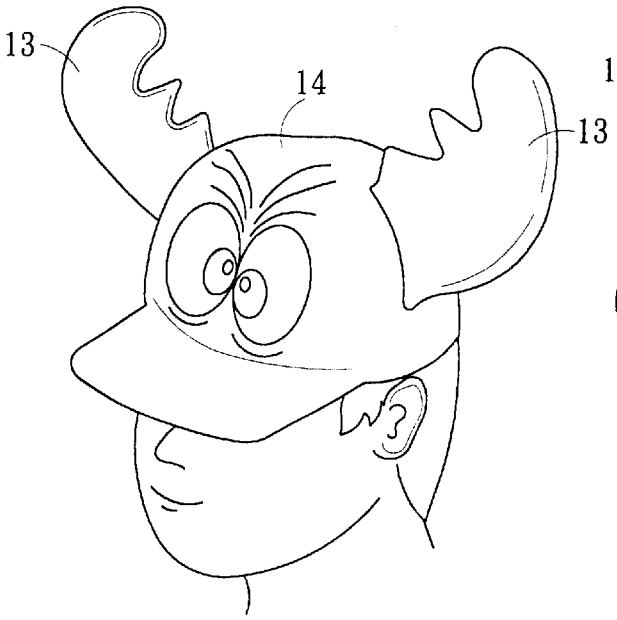
FIG. 2 shows a prior art hat with animal ears.
Figure 4:
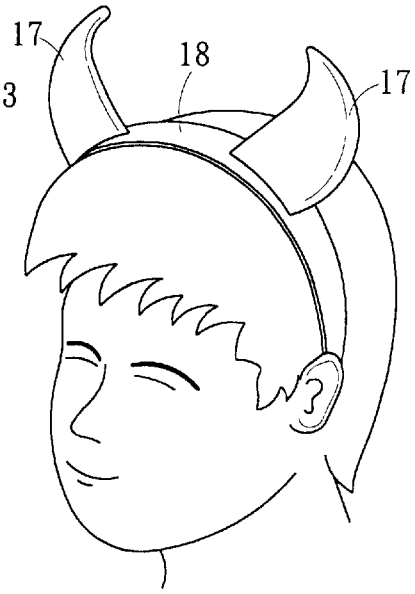
FIG. 4 shows a prior art hair ring with ox horns.
Figure 5:
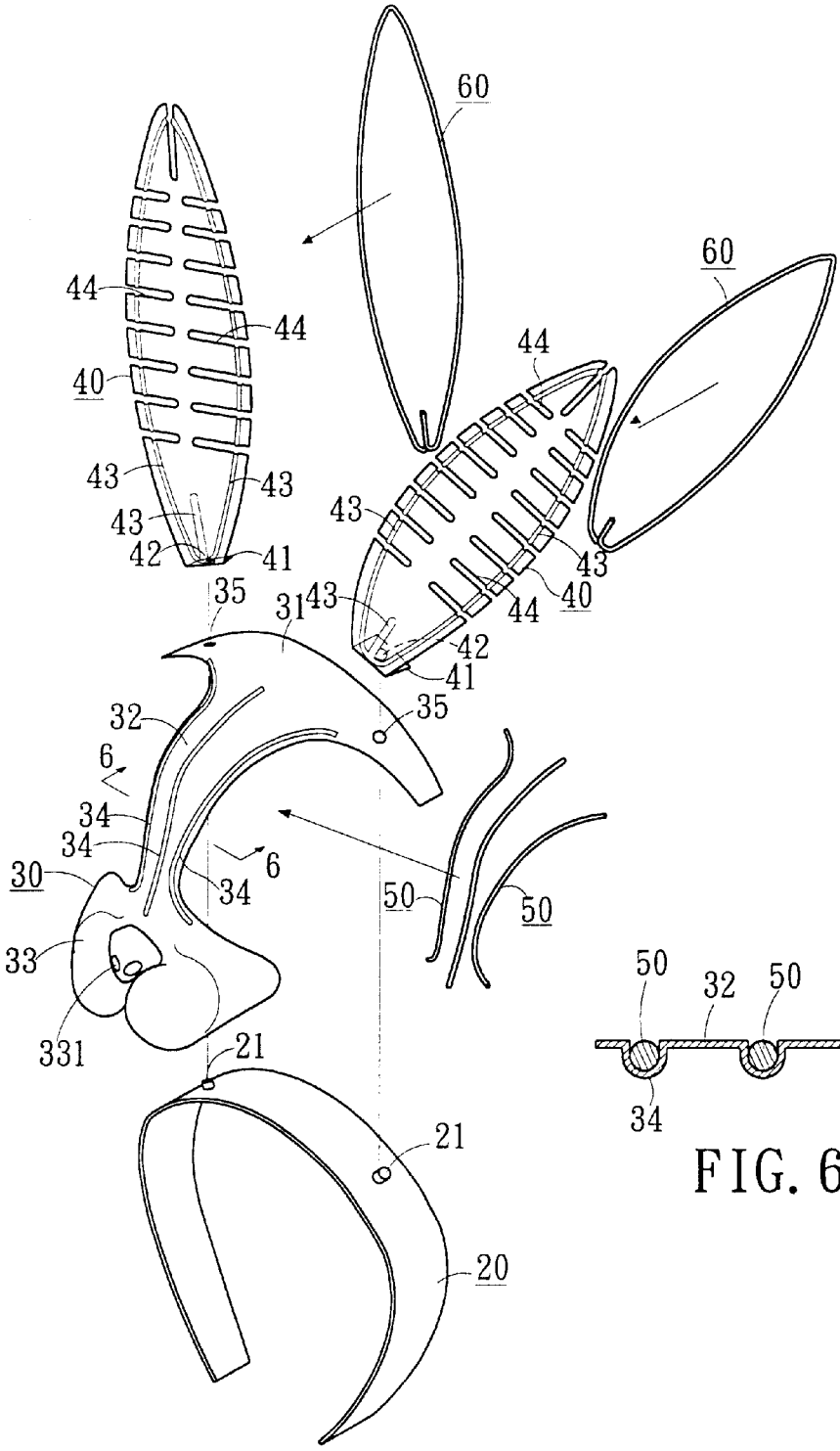
FIG. 5 is an exploded perspective view of a hair ring with a doll mask in the present invention.
Figure 6:
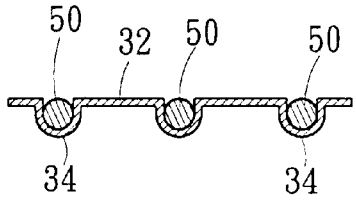
FIG. 6 is a cross sectional view along line 6—6 in FIG. 5.

FIG. 5 illustrates a perspective view of the present invention. The figure discloses a hair ring 20, a plastic mask 30, two plasticzed ears 40 or horns (such as ox horn, goat horn, etc). The hair ring 20 is a cambered jetting rubber ring. The upper end thereof has at least two studs 21. The plastic mask 30 is a thin plastic mold or a transparent casing, which is formed as the face of an animal or a doll through punching or thermal plasticity. The structure has mainly an upper forehead 31 (transversal strip), a central nose bridge 32 (longitudinal portion), and the lower two cheeks 33 (front portion of the lower forehead 31). The central nose bridge 32 is shaped with a plurality of enhancing trenches 34 (see FIG. 6). The enhancing trench is suitable for being installed at two lateral sides and the central portion. Two slender metal wires 50 (see FIG. 6) are embedded into the enhancing trenches 34. Furthermore, the upper forehead 31 is installed with at least two positioning holes 35. Each positioning hole 35 serves to be passed through and positioned by the studs 21 of the hair ring 20 so that the mask 30 is exactly matched with the hair ring 20. As for the lower two cheeks 33 are formed with nose holes 331 at the center thereof for breathing.

Moreover, the folding edge of the bottom of each ear 40 is formed with a positioning hole 42 for being passed through by the stud 21. Two peripherals and center thereof are installed with enhancing trenches 43. Slender metal wires 60 may be embedded into the enhancing trenches. The periphery of each ear 40 is further installed with a plurality of slots 44 which is beneficial for the ears to be prevented from a bad outlook as the ears are bent.

Figure 7:
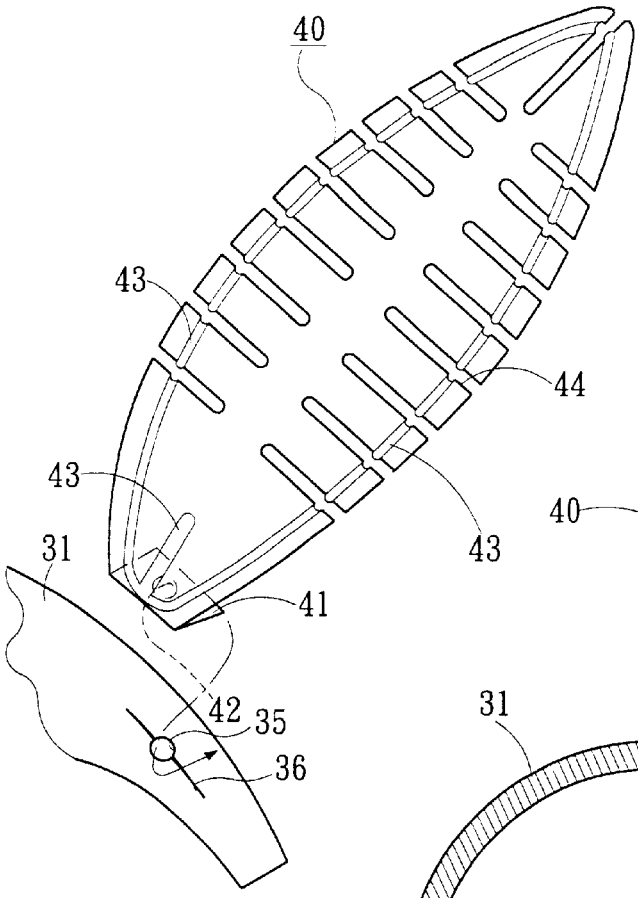
FIG. 7 is another combined perspective view of the hair ring, mask, and ears in FIG. 5.

FIG. 7 shows another combination of the ears and mask. Other then a positioning hole 35, the forehead 31 of the mask 30 has a slit 36. The slit 36 is extended from the positioning hole 35. The slit 36 serves to being inserted by the folded edge 41 at the bottom of the ear 40 so as to be positioned rapidly and exactly.

Figure 8:
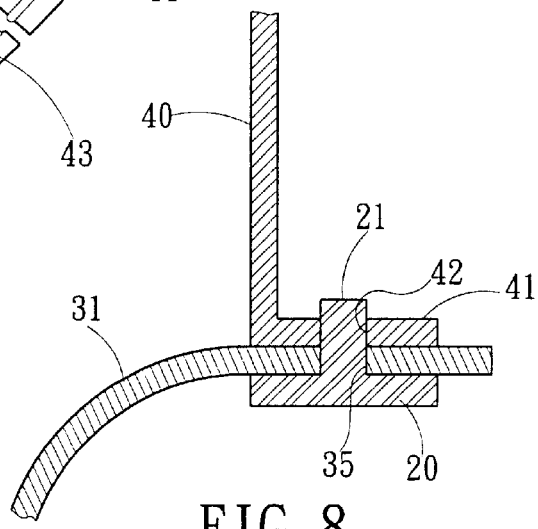
FIG. 8 is an assembled cross sectional view of the hair ring, mask, and ears in FIG. 5.
Figure 9:
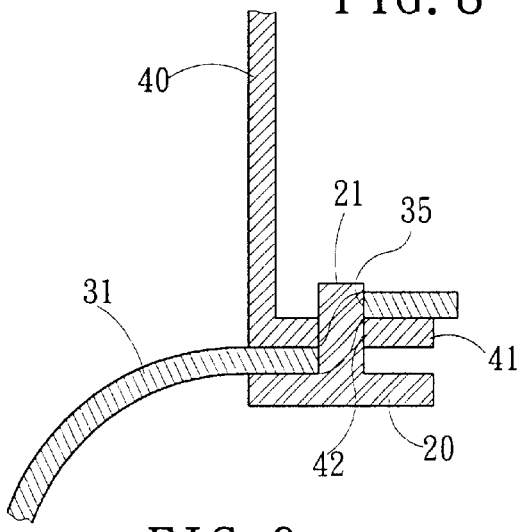
FIG. 9 is an assembled cross sectional view of the hair ring, mask, and ears of FIG. 7.

FIGS. 8 and 9 shows a different combination of the ears 40, the mask 30 and the hair ring 20. FIG. 8 is an extension of FIG. 5. The lower edge of the ear 40 is adhered to the forehead 31 of the mask. While the positioning holes 42, 35 serve for being inserted by the stud 21 of the hair ring 20. Another, FIG. 9 is an extension of FIG. 7, the lower edge of the ear 40 is directly inserted into the slit 36, while the positioning holes 42 and 35 serves for being inserted by the stud 21. Next, if the ear 40 and mask 30 are not positioned through the positioning holes and stud. They may be positioned by sticky.

Figure 10:
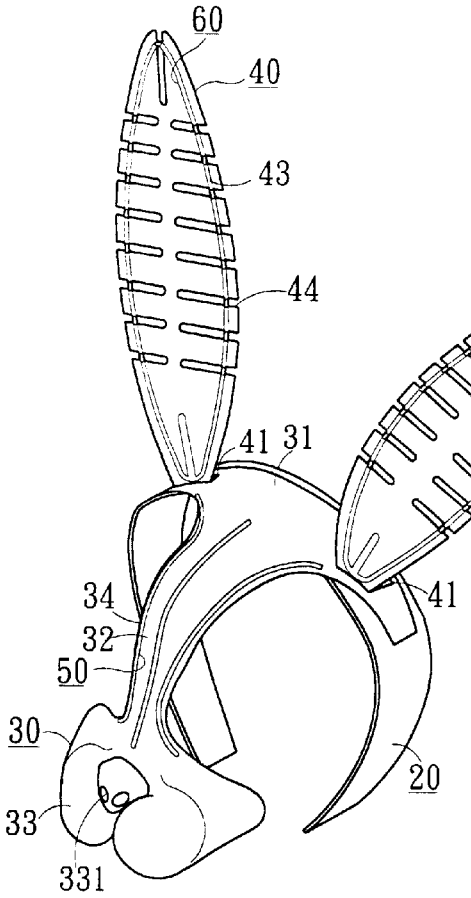
FIG. 10 is a perspective view of the hair ring, mask, and ears of FIG. 5.
Figure 11:
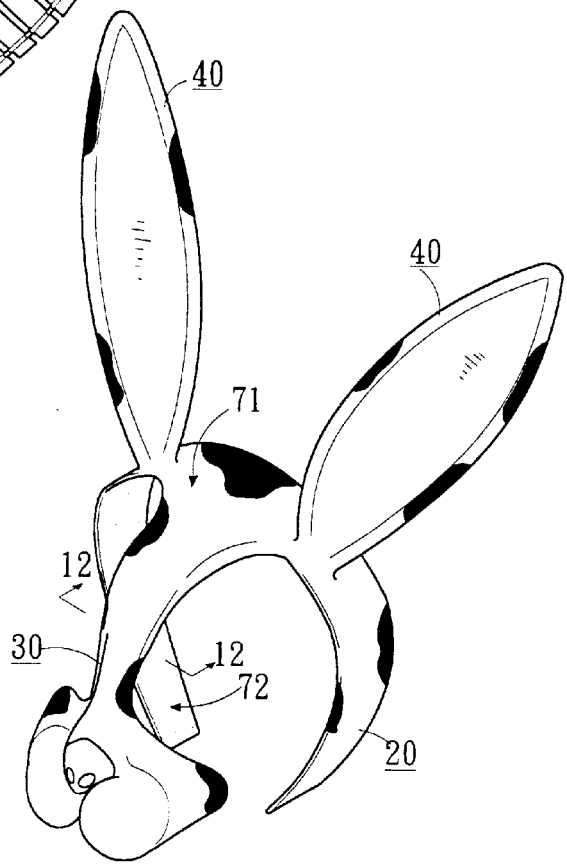
FIG. 11 is an assembled inner and outer layers of the present invention.
Figure 12:
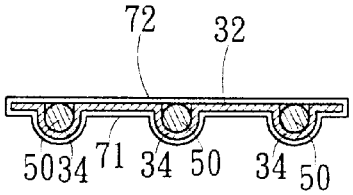
FIG. 12 is a cross sectional view along line 12—12 of FIG. 11.

FIG. 10 is an assembled perspective view of the aforementioned structure. When the aforesaid structure is assembled, an inner and an outer layer 71 and 72 (referring to FIG. 12) can be adhered to the inner and outer wall. The inner and outer layers 71 and 72 may be made of cloth, a terry surface, or a plastic film, or others. When the surface layers are adhered, the enhancing trenches 34 and 43 and metal wires 50 and 60 are shielded. Moreover, they are the skins of the animal or doll. Even a good touching feeling can be achieved through the skin, moreover, the shape of the whole animal or doll can be appeared, as shown in FIG. 11.

Figure 13:
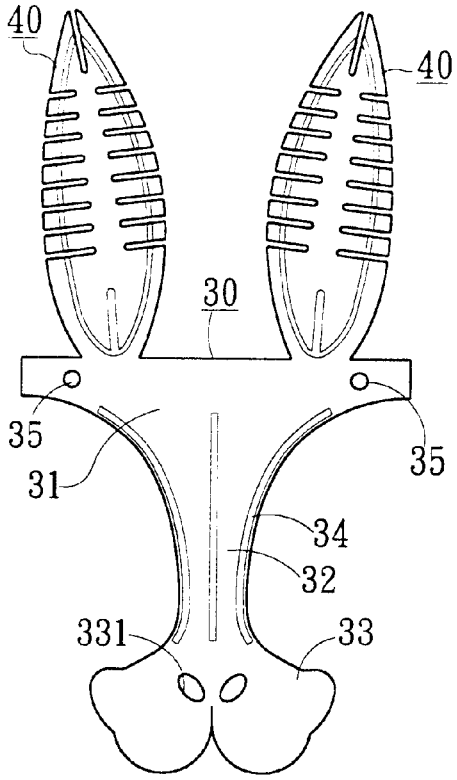
FIG. 13 is another expanded view of another embodiment in the present invention.
Figure 14:
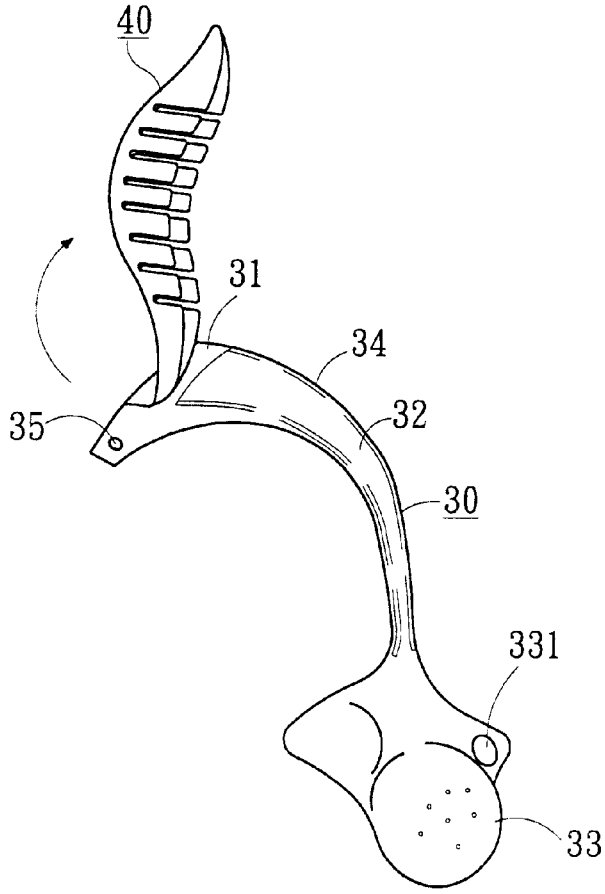
FIG. 14 is a lateral view of a shaped FIG. 13.
Figure 16:
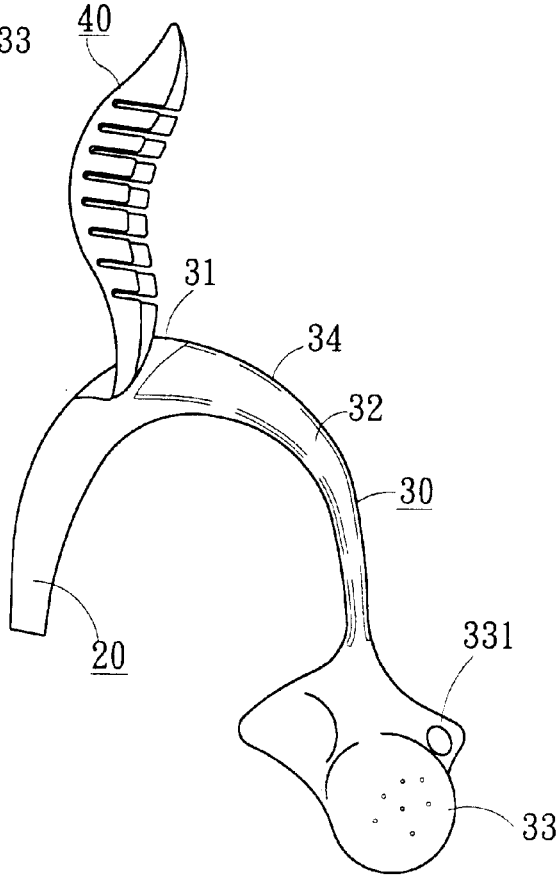
FIG. 16 is a lateral view showing an shaped mask of the present invention.
Figure 17:
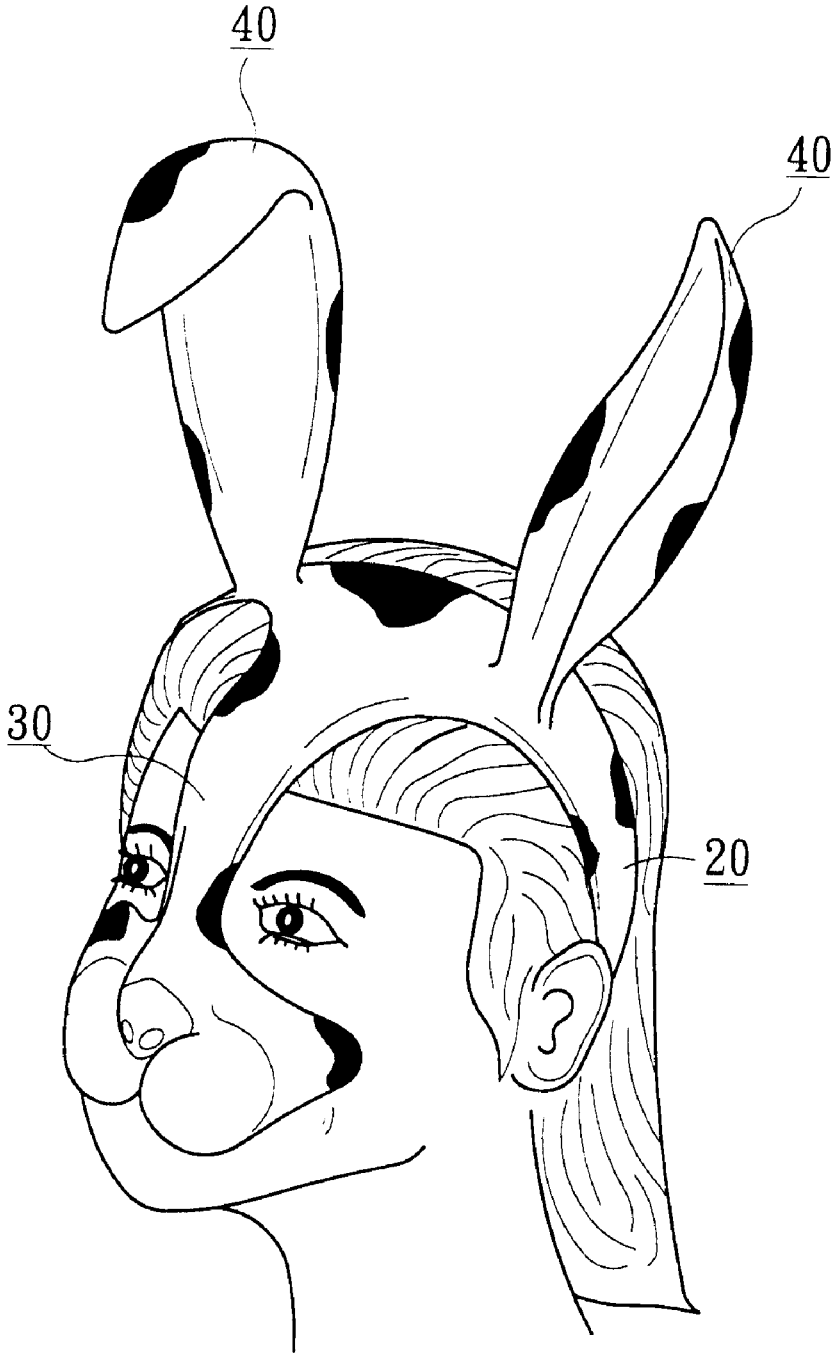
FIG. 17 is a schematic view showing the use of the present invention.

FIG. 13 is an exploded view of another embodiment of the present invention. It is disclosed that the mask 30 and the two ears 40 are integrally formed. Two ears 40 are installed at the forehead 31 of the mask 30. When it is prepared, the thermal molding process is performed, as shown in FIG. 16. Namely, the mask 30 is formed as the face of an animal or a doll, while the ears 40 are shaped after being bent through 90 degrees.

Figure 15:
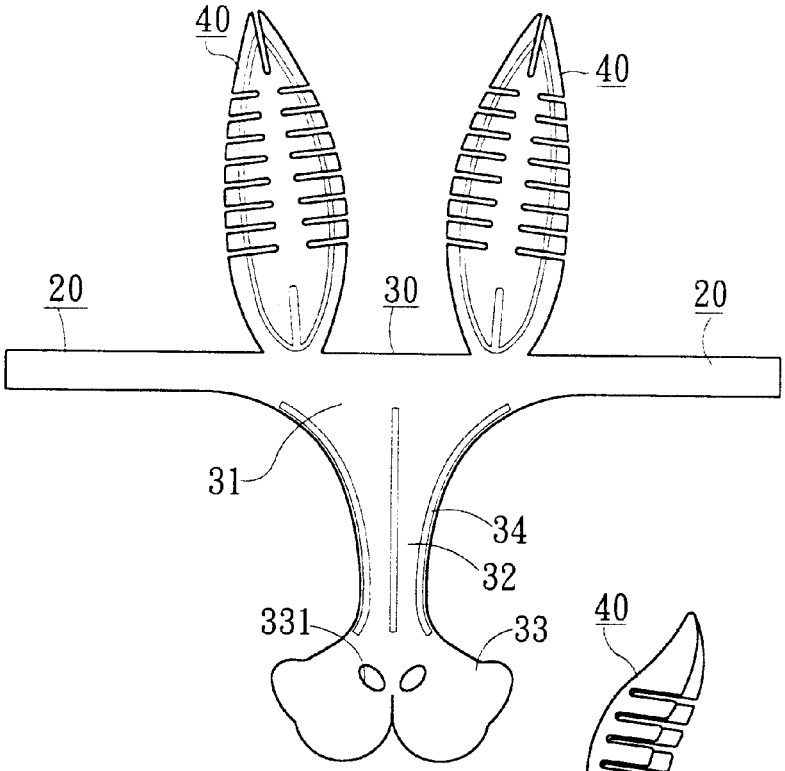
FIG. 15 is an expanding view of another embodiment in the present invention.

In the aforesaid embodiments illustrated in FIGS. 13 and 15, the width of the material is thicker than that disclosed in FIG. 5, while the manufacturing speed is quicker than that described above.

A schematic view of the present invention is illustrated in FIG. 15. When a user wears the present invention, it is only needed to cover the cambered hair ring 20 around the head. Then, the mask 30 is adjusted properly for matching the shape of the face. Eventually, the ears 40 are adjusted to a desired orientation or arc so as to be vivid. Since metal wires 50 and 60 have been embedded into the mask 30 and ears 40 without restoring to the original place. Moreover, the trenches 44 of the ears 40 serve to avoid wrinkles as the ears 40 are bent.

Figure 18:
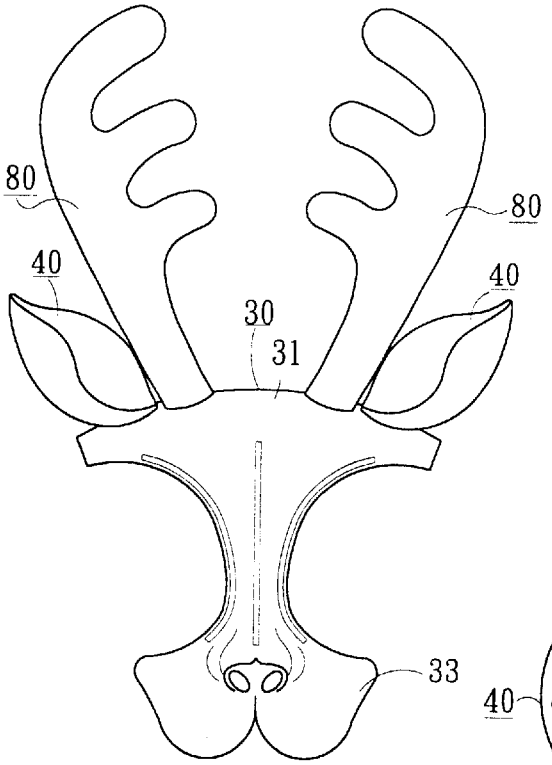
FIG. 18 is another structural schematic view of the present invention.

In the aforesaid mask 30 of animals or dolls, the shapes of the mask 30 and ears 40 can be changed as desired, for example, to be made as a deer, lion, bear, rabbit, dog, cat, ghost, etc. Therefore, the invention is not confined to the shapes illustrated in the figures. FIG. 18 shows horns 80 are added to the mask 30. The retaining way of the horns 80 to the mask 30 are identical to retaining way of fixing ears 40 to the mask 30. The enhancing trenches and embedded metal wires are identical to those in the aforesaid embodiment, thus the details will not be further described herein.

Figure 19:
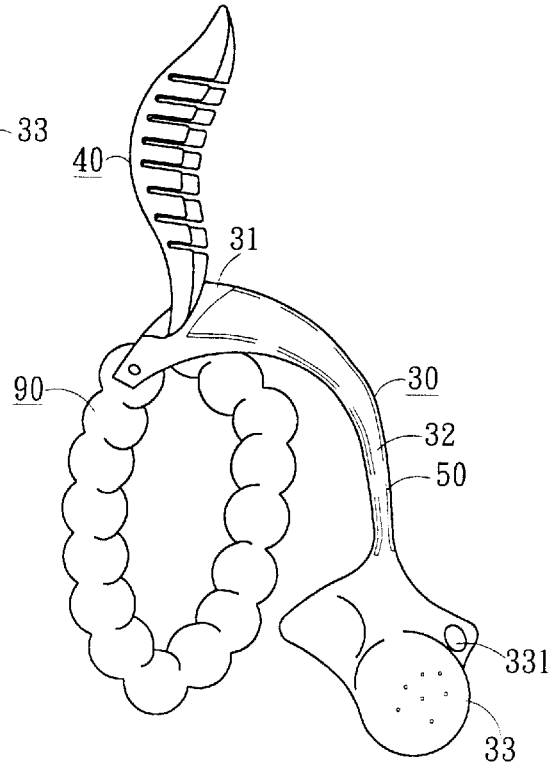
FIG. 19 shows another embodiment of the present invention.

FIG. 19 illustrates another embodiment of the present invention, for the mask structures shown in FIGS. 5, 13 and 15, an elastic hair strip 90 (for example, elastic cord) can be added to the lower ends of the two lateral sides of the forehead 31 of the mask 30 or the hair ring 20. Thereby, the mask 30 is stable after being worn. Thereby, the mask 30 is stable after being worn.

The advantages of the present invention will be described in the following:

1. It is comfortable for wearing, and has a longer lifetime, applies no pressure to the user's face.
2. The mask may shield the face so as to present effects of lovely, vivid, and interesting.
3. It can be shaped according to the shape and favor of users without deformation or restoring to the original shape after being shaped.
4. An elastic cord can be further added to the hair ring or forehead of the mask so as to be more stable and prevent from falling down after being worn.
5. The mask can be made integrally and mass-produced and is formed by thermal molding.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A hair ring with a doll mask comprising:

a hair ring being a cambered plastic ring;

a mask having a shape like a face of a doll, the mask mainly including an upper forehead, a middle nose bridge, and two lower cheeks, and having an upper end for fixing with the hair ring; and two ears being plastic and being fixed to the hair ring;

wherein by the aforesaid construction, the hair ring is worn around the head of a user, and the mask shields the face of the user; the ears serve for adjustment or decoration, so that the wearer feels more comfortable for a longer time without any undesired pressing feeling on the face.

2. The hair ring with a doll mask as claimed in claim 1, wherein the hair ring, mask, and ears are made individually and then are assembled as an integrally body.

3. The hair ring with a doll mask as claimed in claim 1, wherein the mask and ears are formed integrally and then are assembled with the hair ring.

4. The hair ring with a doll mask as claimed in claim 1, wherein the hair ring, mask and ears are formed integrally.

5. The hair ring with a doll mask as claimed in claim 1, wherein the nose bridge at the center of the mask is installed with a plurality of enhancing trenches, and a plurality of slender metal wires are embedded into the trenches.

6. The hair ring with a doll mask as claimed in claim 1, wherein the periphery and center of the ear is installed with a plurality of enhancing trenches, and a plurality of slender metal wires are embedded into the trenches.

7. The hair ring with a doll mask as claimed in claim 1, wherein after the hair ring, the mask and two ears are assembled, surface layers are adhered to an inner and an outer wall of the mask.

8. The hair ring with a doll mask as claimed in claim 7, wherein the surface layer is one of a cloth, a terry surface, and a plastic film.

9. The hair ring with a doll mask as claimed in claim 1, wherein an edge of the ear is added with a banks of slots to accommodate the bending of the ear and prevent wrinkles.

10. The hair ring with a doll mask as claimed in claim 1, wherein two horns are attached to an upper end of the mask.

11. The hair ring with a doll mask as claimed in claim 1, wherein an elastic strip is attached at a lower ends of the mask's forehead portion.

12. The hair ring with a doll mask as claimed in claim 1, wherein the mask is further added with an elastic hair strip.

13. The hair ring with a doll mask as claimed in claim 1, wherein at least two studs are added to the hair ring, and the forehead of the mask and folded edges at lower ends of the ears are formed with positioning holes for inserting the studs.

14. The hair ring with a doll mask as claimed in claim 1, wherein the hair ring has at least two studs; the forehead of the mask is equipped with positioning holes for receiving the at least two studs.

* * * * *